US005718221A

United States Patent [19]

Lobato

[11] Patent Number: 5,718,221

[45] Date of Patent: Feb. 17, 1998

[54] METHOD FOR CONVERSION OF SNOW INTO WATER AND DISPOSAL THEREOF AND SNOW DISPOSAL APPARATUS THEREFOR

[76] Inventor: Emmanuel J. Lobato, 177 Pembrook Dr., Yonkers, N.Y. 10710

[21] Appl. No.: 584,537

[22] Filed: Jan. 11, 1996

[51] Int. Cl.[6] ..... F24H 1/00

[52] U.S. Cl. ..... 126/343.5 R; 126/271.1

[58] Field of Search ..... 126/343.5 R, 343.5 A, 126/268, 271.1, 350 A; 37/227, 229

[56] References Cited

U.S. PATENT DOCUMENTS

| | | | |
|---|---|---|---|
| 553,401 | 1/1896 | Von Garnier | 126/343.5 |
| 840,444 | 1/1907 | Elliot | 126/343.5 X |
| 1,462,527 | 7/1923 | Tully | 126/343.5 R |
| 2,471,733 | 5/1949 | Fiduccia | 37/227 X |
| 3,155,089 | 11/1964 | Hoyt | 37/229 X |
| 3,259,123 | 7/1966 | Sangivanni | 37/227 X |
| 3,382,603 | 5/1968 | Oberto | 37/227 X |
| 3,540,430 | 11/1970 | Rudnik | 126/343.5 R |
| 4,615,129 | 10/1986 | Jackson | 126/343.5 X |

*Primary Examiner*—Larry Jones
*Attorney, Agent, or Firm*—Emmanuel Joseph Lobato; Lobato Law Offices

[57] ABSTRACT

A snow disposal apparatus and a snow conversion system for converting a container into the snow disposal apparatus and the method of converting volumes of snow received in the container into water. The snow conversion system is an assembly of upright supports removably disposed in the container supporting a perforated partition defining within the container an upper space in which volumes of snow to be converted into water are received on the perforated partition and a lower space below the perforated partition into which the water from the converted snow drains. The assembly includes connected pipes supported on the upright supports and a plurality of jet nozzles connected to the pipes supplied with water from the lower space for jetting dense streams of water on to the snow in the upper space at pressure effective to convert the snow into water which drains into the lower space of the container. A driven pump pumps the water from the lower space to the nozzles for jetting dense streams of water on to successively received volumes of snow so that snow converted into water converts the successive volumes of snow into water. Water is drained from the lower space to dispose of the snow as water.

15 Claims, 4 Drawing Sheets

16
65
64
60
20
4A
74
36
39
46
92
79
72
70
13
14
95
96
94
97
4B

METHOD FOR CONVERSION OF SNOW INTO WATER AND DISPOSAL THEREOF AND SNOW DISPOSAL APPARATUS THEREFOR

BACKGROUND OF THE INVENTION

I. Field of the Invention

This invention relates generally to snow disposal and conversion into water for disposal.

II. Prior Art

The removal and disposal of snow from municipalities is generally accomplished by plowing the snow in the streets and moving it toward the gutters where it is left to melt or from where it is carted away to disposal areas. If the streets are busy streets, they must be kept open. If not, the snow is left to melt at the gutters.

Conversion of the snow into water and disposal of the water is not the practice. Apparatus for conversion of large volumes of snow into water is simply not available. The principal reason is because conventional practice is to melt snow by application of heat, which requires expenditures of fuel. It is less expensive to simply cart the snow to an area or river for disposal.

SUMMARY OF THE INVENTION

It is an object of the present invention to provide a mobile apparatus and method of snow conversion into water and disposal of the snow in water form. The conversion of snow to water is by use of kinetic energy of dense jet streams of water on snow to instantaneously convert the snow into water. The application of jetted streams of water onto snow breaks up the snowflakes, and the snow particles and crystals thereof are subjected to collision with water molecules and surrounding of the flakes and particles with water, which is at a higher temperature than the snow crystals or flakes, the snow crystals are rapidly converted into water.

The kinetic energy of the water itself will generate the mechanical energy to not only break up the snow crystals and flakes, but release energy, including heat energy, upon collision for conversion of the snow crystals into water. Water molecules are the same as the molecules in the solid state. Since the molecules are in a liquid state they naturally are at a higher temperature than the snow molecules.

Snow develops a capillarity action if simply brought into contact with water. A pile of snow will melt during the day but the capillary action will form ice when temperatures drop and from cooling internally of the mass. A form of snowflake and crystal agglomeration takes place, in which case the water, even if heated, does not come into contact with the snow crystals internally of such an agglomeration. The use of dense streams jetted onto snow with the necessary velocity and density will preclude the formation of agglomerations of snow crystals and the snowflakes will be broken up and will collide with the water so that substantially instantaneous conversion of the snow into water takes place. This conversion of snow into water is enhanced and accelerated by draining the water resulting from the conversion of snow to water from the area in which the snow is being converted into water, since the snow then does not have the opportunity of developing capillarity activity and agglomeration.

The apparatus and method according to the invention make provision for containing volumes of snow successively received in a space of a conger, which can be mobile, in which the snow is subjected to dense jetted streams of water effective to convert the snow into water. The water from the conversion of snow is continuously drained into another space in the container and recycled as the water applied as the dense jetted streams for converting successively received volumes of snow into water by the water from prior conversions of volumes of snow. The snow is disposed of as water by draining water from the container.

Another object of the invention is to provide a snow-conversion system, for converting snow into water, removably mounted in a container for converting the container into a snow disposal apparatus. The container can be a mobile trash disposal container, for example, which when provided with a snow-conversion system, according to the invention, becomes a mobile snow removal apparatus. The snow-conversion system is a knock-down assembly of uprights supporting a perforated partition positionable in the container volume with a system of jet nozzles, removably mounted on the uprights, that apply dense jet streams of water of the converted snow itself for effecting the conversion of snow on the partition into water.

BRIEF DESCRIPTION OF THE DRAWINGS

The method and apparatus for conversion of snow into water and disposal thereof as water will be better understood from the following description, appended claims and drawings, in which:

DESCRIPTION OF THE PREFERRED EMBODIMENTS

Figure 1:
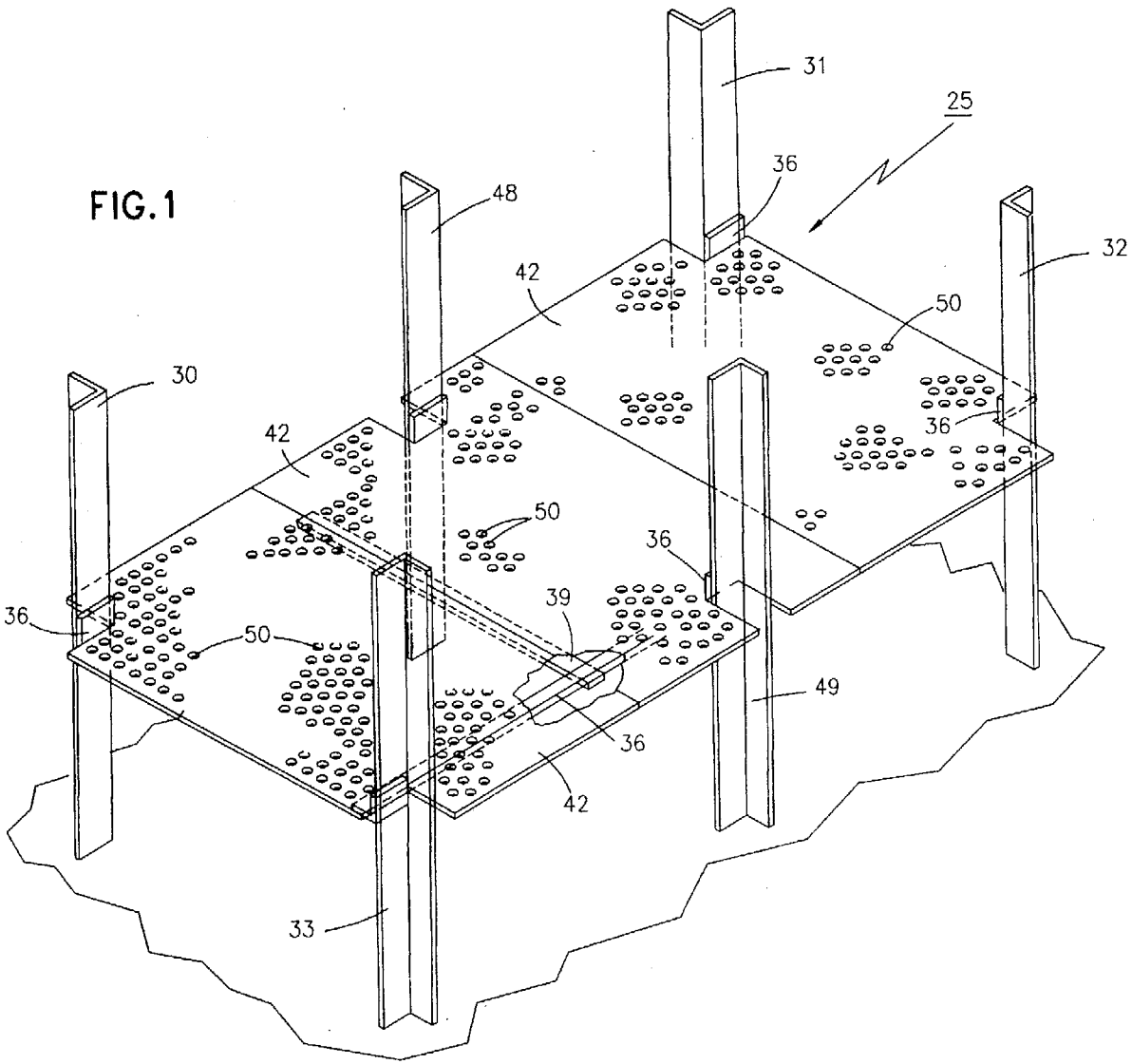
FIG. 1 is a perspective view of an assembly of a snow-conversion system for converting snow into water according to the invention.
Figures 2, 2A:
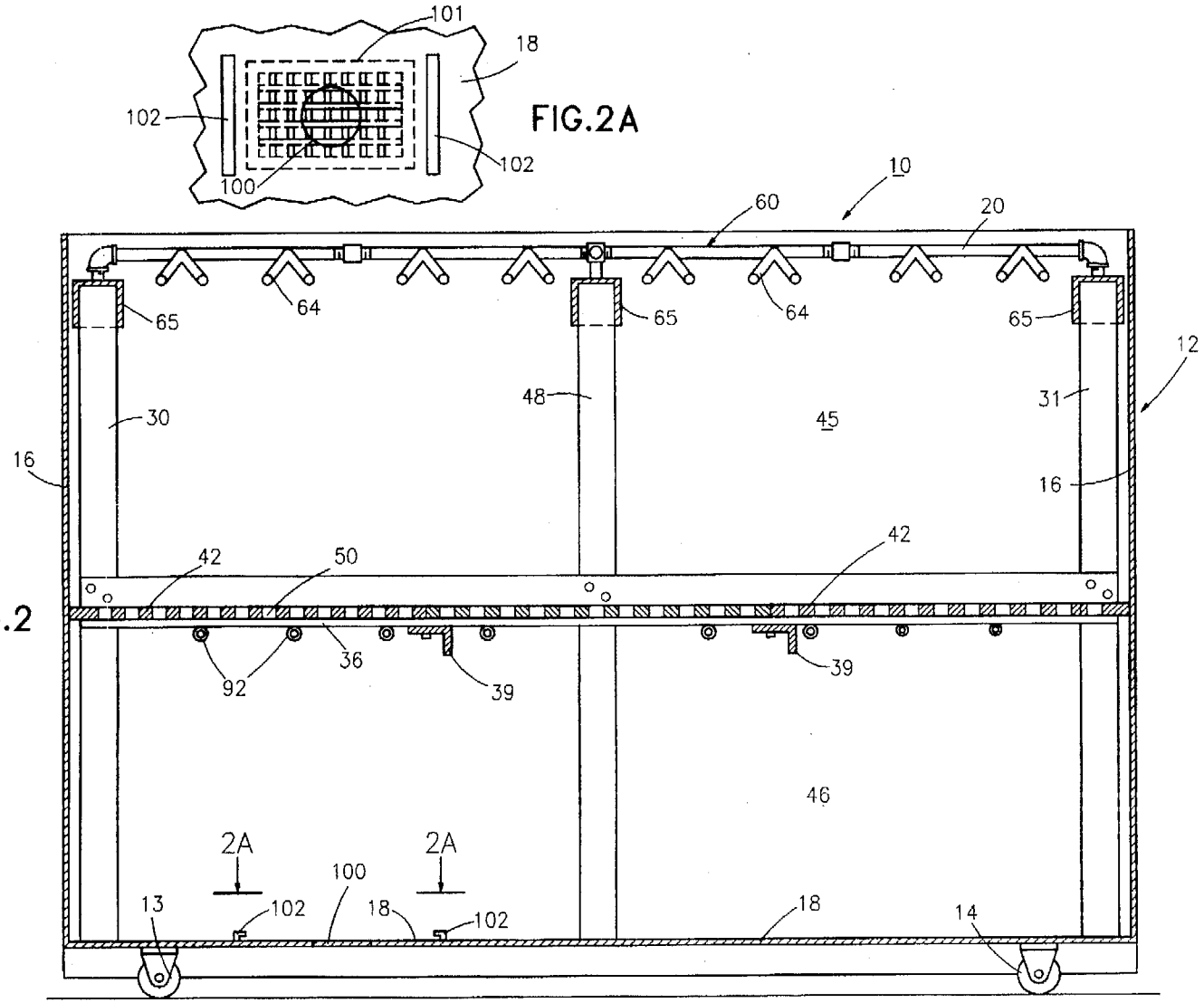
FIG. 2 is a vertical cross section view of a snow-conversion and -disposal apparatus illustrating the snow-conversion system of FIG. 1 in a container according to the invention.
FIG. 2A is a section view taken along a section line shown in FIG. 2.

As illustrated in the drawings, the snow-conversion apparatus according to the invention 10 is a container 12 preferably having wheels 13, 14, on opposite sides of the container so that it can be transported by lifting it up onto a mobile platform, not shown, and can be moved around on a surface at a site where snow conversion is to take place. It should be understood that the surface can be a street surface, and if the container is mounted on a low flat trailer, the container can be visualized as sitting on such a trailer. The container has four side walls which are illustrated as being vertical but can actually diverge from a bottom 18 and is open and has an opening at 20. The container can be fabricated to any suitable size depending on the location of the site at which it is to be used and the volume of snow that is desired to convert into water as described hereinafter. It can likewise be made as a conventional trash container which can be modified with a snow-conversion system 25 illustrated in FIG. 1.

The snow-conversion system 25 comprises a plurality of uprights 30–33 disposed in a configuration suitable for insertion and removal of a knock-down assembly for converting the corresponding container into a snow-conversion apparatus.

The uprights are joined by angle iron longitudinal members 36 on opposite sides of the container and a number of lateral cross members 39 for supporting a plurality of perforated plates 42 forming a perforated partition within the container dividing the container into an upper space 45 and a lower space 46 below the perforated partition and the bottom 18 of the container.

If the container is relatively large, the plates 42 can be any desired dimension for convenient assembly. In a larger container, for example, additional intermediate upright supports 48, 49, can be part of the assembly. The entire knock-down assembly 25 is assembled by bolting the upright supports and lateral angle iron supports and cross members so that the entire system can be readily assembled and disassembled.

The snow-conversion system assembly 25 can be assembled externally of a container and inserted into the container by crane or can be assembled internally of the container by assembling the upright supports and lateral and cross members and then dropping into position the perforated plates 42. The assembly should be strong enough to support a workperson walking on the support plates 42.

The partition plates 42 support large volumes of snow received into the upper space 45. The snow, not shown, is snow removed from streets and parking lots at various sites and is carted and deposited either immediately directly into the container through the opening 20 or can be deposited in the vicinity of the apparatus 10 and then loaded into the upper space 45 by conventional equipment for conversion of the snow into water, as explained later herein.

The partition plates 42 are provided with a plurality of perforations 50. These perforations are dimensioned to permit snow to rest on the upper surface of the plates and to be contained in the upper space 45 in large volumes without the snow passing therethrough to the lower space 46 until it is converted into water. The perforations 50 should be dimensioned to preclude the snow from being washed into the lower space 46 without being converted into water. The density of the perforations 50 is such that the conversion of snow into water in the upper space 45 is possible by the application of dense streams of water, and as the snow is converted into water, the converted snow drains into the lower space 46 without developing a bath in the upper space 45 that would tend to form undesired capillarity action and agglomeration of snowflakes and dense masses of unmelted snow. Thus, the density of the perforations 50 is a function of dimensions of the container and the snow containing space 45 and the dimensions are not shown proportionately in the drawings in FIG. 1.

As part of the snow-conversion system 25, provision is made for an assembly of pipes 60 having a plurality of jets 64 connected thereto. The assembly 60 is supported on the upright supports by caps 65 so that the assembly can be removably mounted on the upright supports.

The conversion of the volumes of snow received in the upper space 45 is effected by an application of jetted dense streams of water through the nozzles 64. The nozzles are disposed so that the jetted water forms a solid pattern of water streams jetted into the upper space 45 onto snow received therein. In this manner the snow is subjected to the kinetic energy of the jetted water throughout the entire volume or area of the upper space 45.

It is, of course, possible to locate valves on the system 60 so that certain nozzles can be closed off in the event that the snow is being received in the upper space 45 only in a given volume thereof and not throughout the entire space. These valves are not illustrated. Preferably, the system is to be used for the rapid conversion of the snow into water by making use of the entire upper space 45 and all of the dense water jets operative to quickly convert the snow in the space 45 into water for disposal as water.

Figures 4, 4A, 4B:
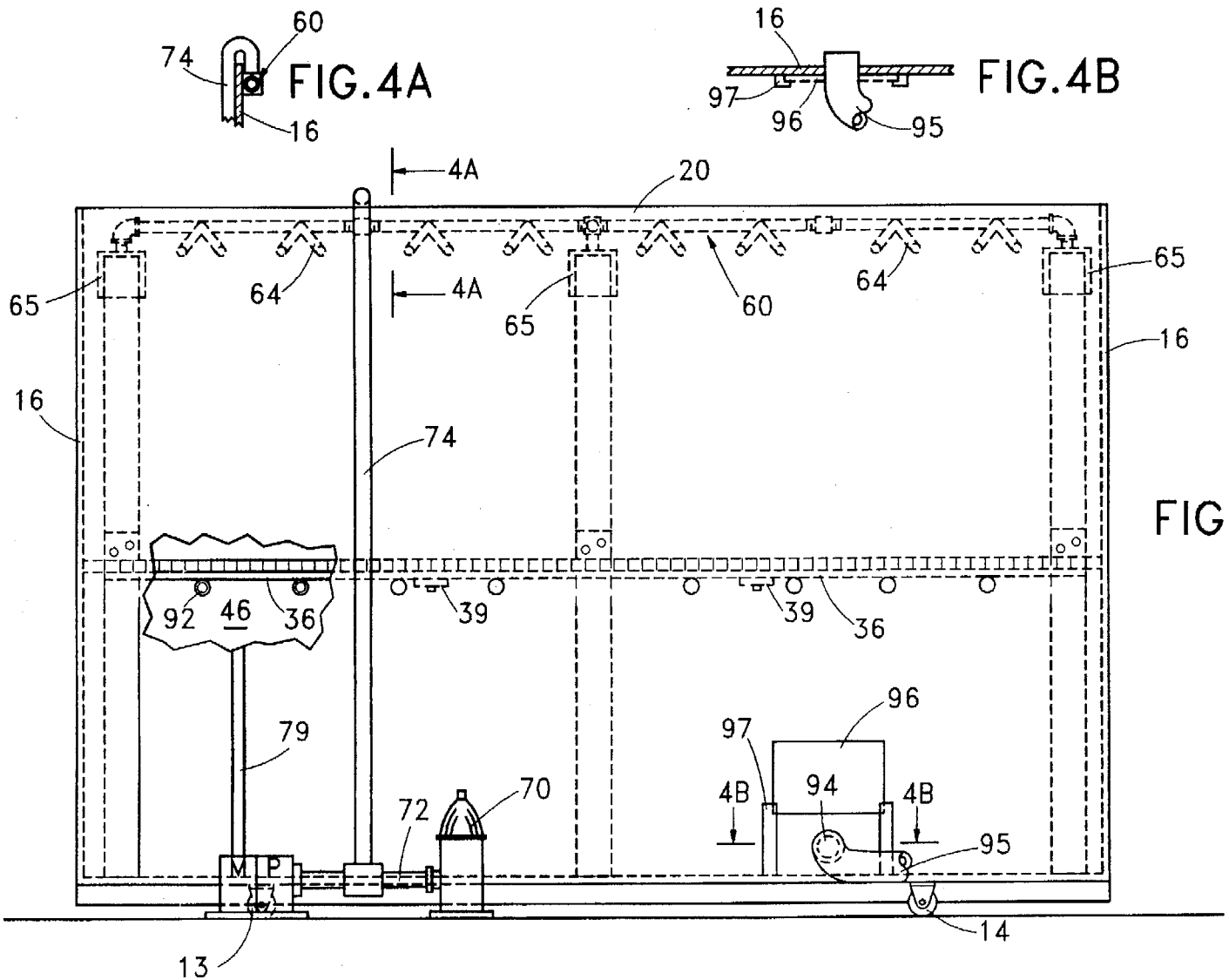
FIG. 4 is a vertical section view of the snow-conversion and -disposal apparatus in FIG. 3.
FIG. 4A is a section view taken along section line 4A of FIG. 4.
FIG. 4B is a section view taken along section line 4B—4B of FIG. 4.

The jets of dense streams of water jetted from the nozzles 64 are those of the recycled snow which has been converted into water. In order to initiate the operation, water is provided to the apparatus from an external source simply to start the apparatus, and thereafter the conversion of snow to water is done solely with the converted snow itself. Thus, provision is made for providing the nozzle 64 with water from an external source such as a fire hydrant 70, shown diagrammatically in FIG. 4A. The fire hydrant is connected to a connection 72 to a pipe riser 74 connected to the pipes or conduits delivering water to the nozzle 64. The connection 72 is shown diagrammatically, but it is clear that this connection is a hose which can be connected to a fire hydrant which is close or adjacent to the site at which the container is positioned or it can be somewhat remote. The snow volumes first received in the upper space 45 are subjected to the dense streams of water provided from the fire hydrant. The connection 72 can actually be a hose from a fire hydrant which can be used to deliver water directly to the snow through the upper opening of the container, if desired. Preferably, however, the connection 72 should be established with the nozzle 64 to carry out the optimum mode of operation of the apparatus.

Once there is water in the lower space 46, a suction is taken through a line 79 at the bottom of the container by a pump P driven by a motor M which discharges through a connection 80 to the riser 74 and the conversion water is effected by the water from the snow itself. The supply of water from an external source such a fire hydrant 75 is terminated so that there is no further need of a source of water externally. Thus, it is possible to position the apparatus in the vicinity of a fire hydrant for initiating the operation.

It is also clear that actually a volume of water can be provided in the lower space 46 before the apparatus is moved into position and that the water is then available for initiating operation of the apparatus.

The motor-driven pump P has to have the capacity for delivering water to the nozzle 64 depending upon the size of the apparatus. Since kinetic energy is the principal conversion force for breaking any agglomeration that may take place, breaking up the snow crystals, the pump has to deliver a range of water under pressure at pressures effective to carry out the conversion of snow into water. Thus, snow that has ice crystals will require higher pressure jet streams than snow which does not have as much ice crystal content and is less compacted. The motor-driven P is mounted externally of the container at the site at which the conversion is taking place.

Figure 3:
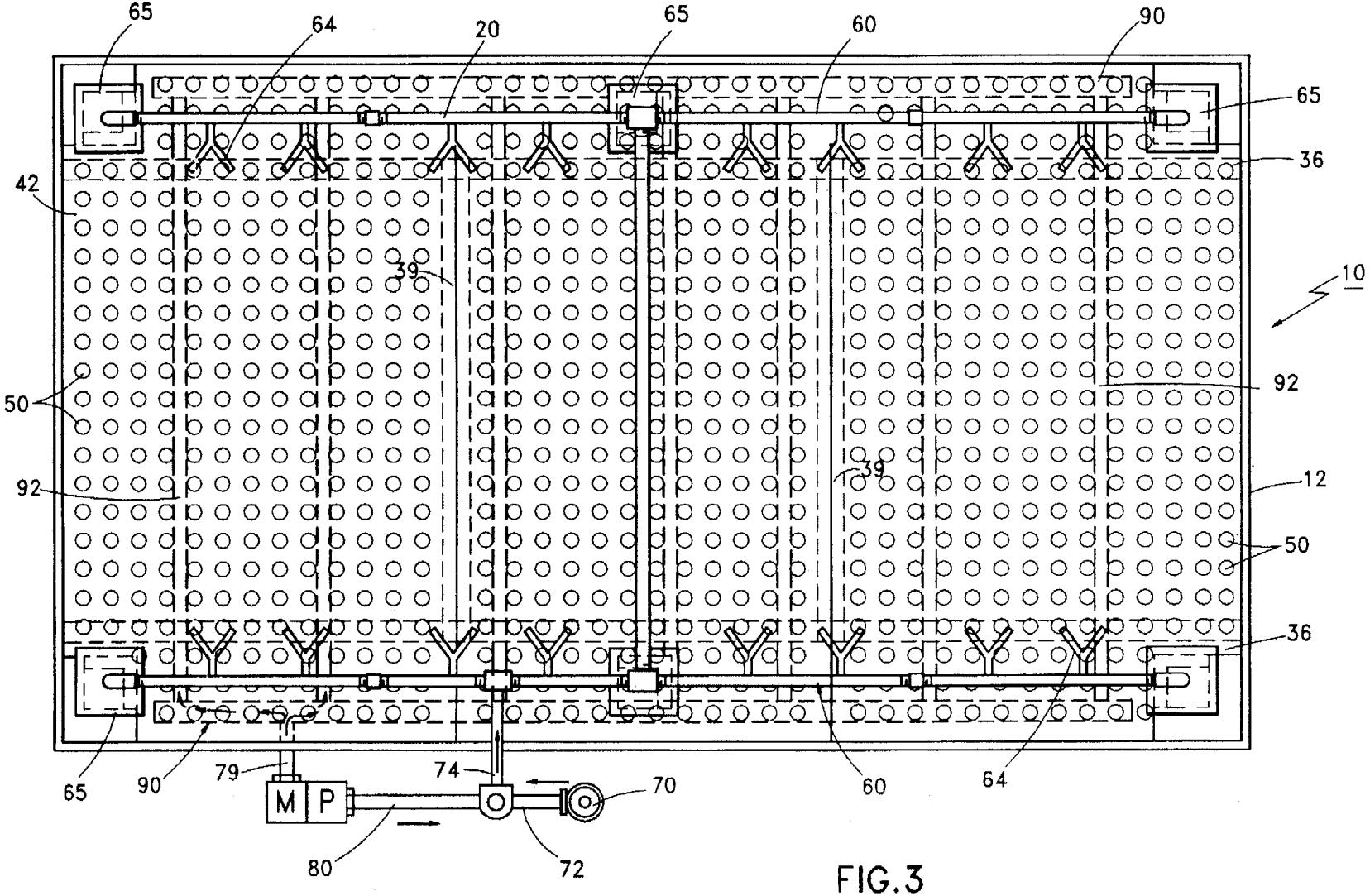
FIG. 3 is a plan view of the snow-conversion and -disposal apparatus in FIG. 2.

In the arrangement shown in FIG. 3, the motor M is an internal combustion engine having an exhaust system 90 connected thereto. The system 90 has a plurality of conduits 92 which are connected longitudinally of the container and transversely thereof to form a heat exchanger system which is supported on the underside of the partition plates so that the heat developed by the exhaust of the motor M heats the partition plates to whatever degree of the system exhaust develops so that the heat exchanger is a heat-recovery system or an economic exchange of heat onto the plates so that the conversion of fuel to heat in the motor M proves the economy of the system. It is, of course, understood that the heat exchange system is simply an addition for improving the efficiency of this system and is not necessary to the water-conversion system since the conversion of snow into water is accomplished by the recycled water itself and the breaking-up of the snow crystals and immediately colliding the snow crystals with high velocity dense particles of water so that the transfer of heat from the water itself and its kinetic energy can carry out the snow melting operation. Thus, the motor M can actually be an electric motor if electrical power is convenient to any of the sites in which the apparatus is used.

The carting of the snow to the snow-conversion apparatus can be kept to a minimum by locating the apparatus or several apparatuses at convenient points in a municipality so that the distance that any carting takes place can be minimized. The snow need be carted only to a site at which an apparatus is located. Thus, the use of a plurality of the type of apparatus shown at convenient points will reduce turn-around time of trucks carting snow to be converted to water. The rapidity with which snow removal can take place and disposal thereof as water can be greatly reduced.

An advantage of the apparatus is that the snow is disposed of as water. Thus, the snow converted into water is simply disposed of by draining water from the lower space 46 of the apparatus. Thus, a drain connection 94 is provided on a side of a container for connection of a hose 95 to drain the water to a sewer system, for example, of a municipality. If the container is to be used as a trash, container or some other function, it is provided with a slide 96 movable up and down on slide guides 97. Thus, when the hose is disconnected, the drain connection 94 is closed off by sliding the slide cover 96 downwardly, and the container can then be freely used as a trash container, for example.

If the container is to be located directly over the grating of a sewer system, the bottom 18 can be provided with a drain opening 100 which can be opened and closed by a slide cover 101 guided on end guides 102 so that the bottom drain 100 can be closed off and the bottom 18 closed so that the container can be used as a trash container or for any other desired use. Thus, the container can haste both a side drain and a bottom drain for draining water as flows out of the lower space 46 and the snow converting into water is rapidly discharged and disposed of.

A municipality can make use of the apparatus by disposing it at different convenient locations. Businesses can use the apparatus by locating one or more such units in an area, for example, a large parking lot, from which snow is to be removed and disposed of rapidly rather than simply scraping or plowing the snow and piling it, the entire parking area can be used and rapidly prepared for complete use during or after a snowfall.

It can be seen that the economy of the system not only applies to the use thereof for rapidly and economically disposing of snow but also provides for economy of snow disposal in a municipality by the reduction of the use of the number of trucks for snow haulage. Furthermore, the reduction in the use of salts and different forms for melting of snow is a monetary consideration. The simplicity of the system for snow conversion for converting a container into a snow conversion apparatus into water and disposal thereof is inexpensive. It can be rapidly assembled for use with different types of containers and is rapidly disassembled when not in use and the container used for other purposes. The knock-down assembly can readily be stored for use during the winter season and is quickly assembled for converting a container into a snow-conversion apparatus so that the apparatus can be put into effective use quickly and inexpensively.

While the snow-conversion system is shown as being a knock-down assembly, it should be realized that the container itself can also be made as a knock-down assembly so that the entire apparatus can be easily stowed away and assembled when needed. Moreover, the perforations 50 can be made of different sizes, and a mesh screen, not shown, can be laid over larger size perforations to keep the snow above the partition and allow the water to drain rapidly. Any ice collecting above the partition can be readily raked off with a flat rake to allow the desired rapid draining into the lower space of the container.

Those skilled in the art will understand that sheet metal can be used as the perforated plates if of sufficient gauge thickness. The container can be placed near a body of water or on a pier, and the initial water can be taken from the body of water and the snow convened into water can be drained into the body of water. Moreover, the container can actually be the part of a long truck that can be loaded with snow. The apparatus is then completely self-propelled for movement to different sites. The truck can be loaded by front loaders so that the apparatus is essentially mobile for loading at different sites and water disposal at different sites.

What I claim is:

1. A movable snow disposal apparatus comprising:

a container having sidewalls, a bottom and a top opening for receiving volumes of snow in the container for conversion into water therein and disposal therefrom as water;

a snow conversion system in the container having a perforated partition disposed defining a lower space in the container between the perforated partition and the bottom and an upper space above the perforated partition for receiving successively volumes of snow on the perforated partition for conversion into water; a plurality of connected jet nozzles supported above the perforated partition to apply directly on the snow received in the upper space jetted dense streams of water at a pressure and at a density and velocity for kinetic energy of the dense streams of water to break up masses of snow and snow particles and snowflakes to eliminate agglomeration of snow crystals and snowflakes and avoid capillarity activity of the snow and agglomeration thereof thereby to effectively convert the snow into water and drain through the perforated partition into the lower space;

means including a driven pump for pumping water from said lower space to said nozzles for recycling water from said snow as said dense streams of water under pressure and at a velocity effectively converting the snow into water without need of a source of heat; and means for draining of water from said lower space for disposal thereof.

2. A movable snow disposal apparatus according to claim 1, including means for rendering the container mobile.

3. A movable snow disposal apparatus according to claim 2, in which said driven pump has a motor connected thereto having an exhaust system.

4. A movable snow disposal apparatus according to claim 3, including heat exchanger tubes mounted in said partition for receiving said exhaust from said motor to maximize energy conservation of the apparatus motor.

5. A movable snow disposal apparatus according to claim 1, in which said snow conversion system is removable as a unit from said container to allow other use of the container and is replaceable into said container for converting the container into a snow removal apparatus.

6. A movable snow disposal apparatus according to claim 1, in which said snow conversion system is a knock-down assembly removably disposed in said container, said assembly comprising a plurality of assembled upright supports supporting said perforated partition substantially horizontally, a plurality of pipes connecting said nozzles removably supported on said uprights.

7. A movable snow disposal apparatus according to claim 1, including a drain connection to said container lower space.

8. A movable snow disposal apparatus according to claim 1, including means for draining water from said lower space to dispose of water from the converted snow.

9. A movable snow disposal apparatus according to claim 1, in which said container is usable as a trash disposal container when empty, and in which said snow conversion system is removably mounted in the empty container for converting the trash disposal container into said snow disposal apparatus.

10. A snow conversion system for converting an open-top container into a snow disposal apparatus comprising:

an assembly of laterally spaced upright supports positionable removably internally of the container;

at least one perforated plate supportable on said uprights as a perforated partition defining within the container a lower space between the perforated partition and bottom of the container and an upper space above the perforated partition for receiving volumes of snow on the perforated partition;

an assembly of pipes removably supportable on the uprights including jet nozzles connected thereto for jetting dense streams of water directly on said snow on the perforated partition at a pressure and at a density and velocity for kinetic energy of the dense streams of water to break up masses of snow and snow particles and snowflakes to eliminate agglomerations of the snow crystals and snowflakes and avoid capillarity activity of the snow and agglomeration thereof thereby effectively to convert the snow into water and drain through perforations in said perforated partition into said lower space; and a driven pump connected to said pipes for pumping water from said lower space to said jet nozzles for recycling water from said snow as said dense streams of water and effectively to convert to water the snow received in the upper space.

11. A snow conversion system according to claim 10, in which said assembly is a knock-down assembly.

12. A snow conversion system according to claim 10, in which said container is a container for transporting trash for disposal when not in use for snow disposal and the snow conversion system is removed therefrom.

13. A movable apparatus according to claim 10, in which said perforated partition is disposed substantially horizontally in said container.

14. A transportable apparatus for converting snow into water without need of heat and disposing of the water comprising:

a container having an opening for receiving large volumes of snow and having therein a snow conversion system comprising a perforated partition disposed in the container dividing the container internally into an upper space into which the large volumes of snow are received successively and converted into water and a lower space between said upper space into which the water drains through said perforated partition;

means in said snow conversion system for taking a suction on the water from said snow in said lower space and including means for continuously applying the water from said snow as jetted dense streams directly on the snow as received in said upper space at a stream density and velocity effective for the kinetic energy of the water in the streams to break up snow agglomeration and convert the snow into water without need of heating the water of said dense streams and drain through said perforated partition into said lower space; and means for draining water from said lower space to dispose of the snow converted into water.

15. A transportable apparatus according to claim 14, in which said snow conversion system is removably disposed in the container and replaceable therein, whereby the container is available for different uses.

* * * * *